US007878184B2

(12) United States Patent
Klarborg

(10) Patent No.: US 7,878,184 B2
(45) Date of Patent: Feb. 1, 2011

(54) HARDBALL WEAPON

(76) Inventor: Martin Klarborg, Roedhusvej 201, Pandrup (DK) 9490

( * ) Notice: Subject to any disclaimer, the term of this patent is extended or adjusted under 35 U.S.C. 154(b) by 156 days.

(21) Appl. No.: 12/302,965

(22) PCT Filed: May 31, 2007

(86) PCT No.: PCT/DK2007/000258

§ 371 (c)(1),
(2), (4) Date: Apr. 9, 2009

(87) PCT Pub. No.: WO2007/137587

PCT Pub. Date: Dec. 6, 2007

(65) Prior Publication Data

US 2009/0235911 A1 Sep. 24, 2009

(30) Foreign Application Priority Data

May 31, 2006 (DK) ..... 2006 00737

(51) Int. Cl.
*F41B 11/00* (2006.01)

(52) U.S. Cl. ..... 124/65

(58) Field of Classification Search ..... 124/63–68, 124/70–77

See application file for complete search history.

(56) References Cited

U.S. PATENT DOCUMENTS

| | | | | |
|---|---|---|---|---|
| 5,261,384 | A * | 11/1993 | Hu | 124/66 |
| 5,531,210 | A | 7/1996 | Meiser et al. | |
| 6,564,788 | B1 | 5/2003 | Hu | |
| 7,077,117 | B1 * | 7/2006 | Chu | 124/32 |
| 7,191,775 | B1 * | 3/2007 | Lo | 124/65 |
| 7,694,448 | B2 * | 4/2010 | Iwasawa | 42/54 |
| 7,712,462 | B2 * | 5/2010 | Pedicini et al. | 124/65 |
| 7,730,881 | B1 * | 6/2010 | Pedicini et al. | 124/65 |
| 2003/0098019 | A1 * | 5/2003 | Hu | 124/66 |
| 2006/0243263 | A1 * | 11/2006 | Tsurumoto | 124/66 |
| 2007/0000483 | A1 * | 1/2007 | Tsurumoto | 124/73 |
| 2007/0289586 | A1 * | 12/2007 | Tsurumoto | 124/73 |
| 2009/0056693 | A1 * | 3/2009 | Pedicini et al. | 124/73 |

FOREIGN PATENT DOCUMENTS

| | | | |
|---|---|---|---|
| GB | 2 264 066 | A | 8/1993 |
| JP | 2006-170474 | A | 6/2006 |
| WO | 2005/066576 | A1 | 7/2005 |

* cited by examiner

*Primary Examiner*—Troy Chambers
(74) *Attorney, Agent, or Firm*—Roberts Mlotkowski Safran & Cole, P.C.; David S. Safran

(57) ABSTRACT

A hardball weapon for use in exercises or shooting games and designed as military gun is made with a weapon housing (3) containing two coaxial pistons (21, 26) which are mounted directly in the weapon housing (3) and driven by an electric motor (10) via a gear wheel mechanism (12, 18) and toothed racks (24, 25). The first outer piston (21) functions as a movable bolt for loading the cartridge chamber with cartridges (7) with solid balls (6), and the other piston (26) functions as a pressurised air piston for creating an overpressure for firing the balls (6). The weapon housing (3) can be opened by pivoting, thereby giving access to the parts in the firing mechanism for inspection, repair and adjustment.

3 Claims, 11 Drawing Sheets

HARDBALL WEAPON

FIELD OF THE INVENTION

The present invention concerns a hardball weapon for hobby or exercise applications which resembles real firearms, such as pistols and military guns (assault rifles), and of the kind where an electromechanical unit in the weapon produces an air pressure that drives a bullet or ball out of the barrel of the weapon. The balls are spherical, solid and of plastic or other relatively light materials, a difference from paintball weapons that are driven by gas from a pressurised gas container on the weapon, firing hollow balls containing a dye.

BACKGROUND OF THE INVENTION

Prior art hardball weapons are lifelike copies of real handguns, and in these weapons the electromechanical unit is arranged in a closed box which in production makes it easy to mount in the weapon housing between the butt and the barrel. The prior art weapons have a single piston which is moved back and forth for producing an air pressure for firing balls. The balls in the prior art weapons lie in the magazine without casings and are moved to the barrel with a special mechanism, thus providing space for many balls in each magazine. This means some drawbacks at existing electrically driven hardball weapons:

The durability is minimal. The gear box in the weapon housing itself entails that the parts have to be relatively small to be there, and the parts are not made of materials enhancing durability either. The gear wheels in the gear are all of white metal and may break their teeth, the foremost part of the gear box may break due to the impacts from the piston, the teeth of the piston are quickly worn and the gear wheels may jam each other. Therefore, electric hardball weapons have relatively short service life between service or repair.

When a gun malfunctions, it is to be disassembled into up to twenty parts, depending on the model, just to get into the gear box, where the mechanism, and in far the most cases also the problem, resides. Having reached the gear box, additional eight screws have to be screwed off to open it, and the spring jumps out and often it throws other parts out, and then one has to use time to look for the parts. This happens even before one has found the possible defect. Electric hardball weapons are difficult to strip, and the parts are difficult to replace due to the inner shell in which they are concealed.

The construction is made as a box within another box, and the parts are therefore small, and tuning the weapons, i.e. increasing the muzzle velocity, is difficult and expensive. The parts have to be made extra strong, and the tunings are, depending on the force, less durable and are subjected to extreme wear. Hardball weapons are only used in tuned condition at higher levels of sport in order to increase firing range and realism, but implying some problems for the users.

In the hardball game, there are firing limits depending on the velocities. If a gun fires with less than 100 m/s, it may be used in-house for close combat (room fighting), i.e. at short range. Below 130 m/s, the weapons may only be used at longer ranges, but both fully automatically and semi-automatically. As of 140 m/s and higher, you are a long-range rifleman who is only allowed to shoot across very long distances and only semi-automatically (single shots). You are therefore forced to choose what to do. When playing the game on ranges with both houses, woods and large field areas, this is a problem. If shooting too hard, you are lost if you are to hunt the "enemy" into a house where you have to draw a side weapon (pistol), and if shooting with less than 100 m/s, the hard-shooter may stand in safety and shoot across long distances without being able to shoot him. The muzzle velocity in locked on electric hardball weapons.

The hardball weapon does not have functions looking like the functions of real weapons, besides the shot and the drawing off. Realism is lacking compared with e.g. military training. SWAT and other forces, like Secret Service, use hardball and paintball weapons for their training. This is only for simulating the shot and the feeling of being hit by something that hurts. The weapons are not realistic enough in order that it is possible as a soldier to imagine the exercise as a live situation. One is not to go through the loading motions on a hardball weapon, and one does not have to save ammunition as there may be up to 600 shots in a single magazine on some models. On top of that, hardball weapons also lack precision. If the balls hit randomly for each sighted shot, the exercise is wasted, and as a solder or police officer you have learned nothing.

OBJECT OF THE INVENTION

The purpose of the invention is to reduce or relieve the above drawbacks of the prior art electric hardball weapons. It is particularly the object to provide a hardball weapon having simpler and more dependable construction, and it is furthermore the intention to provide a firing mechanism which is easy to service and repair. Moreover, it is an object to increase realism by imitating the design and size of the ammunition as in powder-driven guns, so that the weapon is more suited for training for professional users of weapons, like soldiers and police officers.

This is achieved by a hardball weapons as specified in claim 1, where the firing mechanism is mounted directly in the casing of the hardball weapon. This is avoided by using a box or similar enclosure for the gear box and firing mechanism. Thereby, the individual parts herein are made stronger and larger within the existing weapon housing that has the shape and dimensions as the original powder-driven hand weapon. Furthermore, by the firing mechanism according to the invention it is possible to adjust or tune the firing power during exercises, if only a few minutes are available between different stages during the exercise or game.

DESCRIPTION OF THE DRAWING

An embodiment of the invention is described below with reference to the drawing, in which.

EMBODIMENT EXAMPLES OF THE INVENTION

Figure 1A:
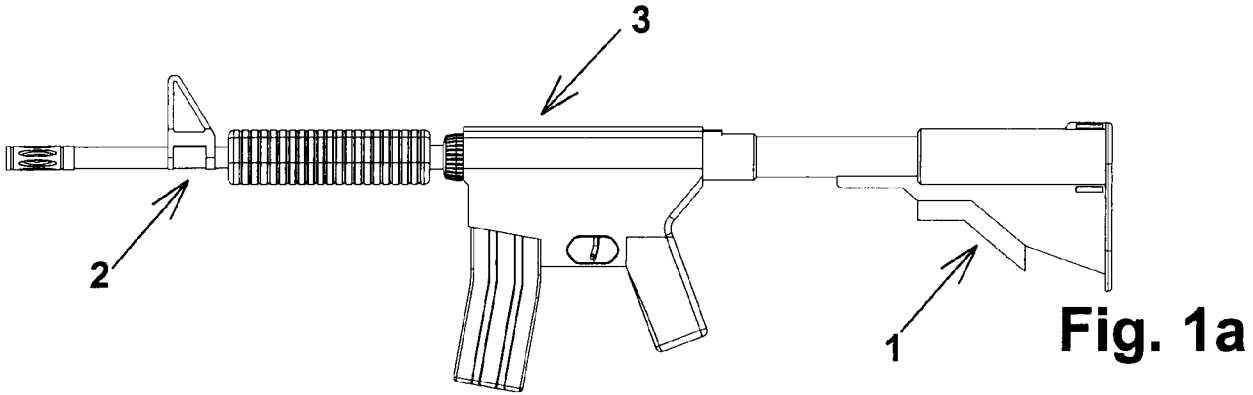
FIGS. 1*a*-1*c* show an embodiment of a hardball weapon according to the invention as seen from the side, in section along the line A-A in FIG. 1*c*, and from above, respectively.
Figure 1B:
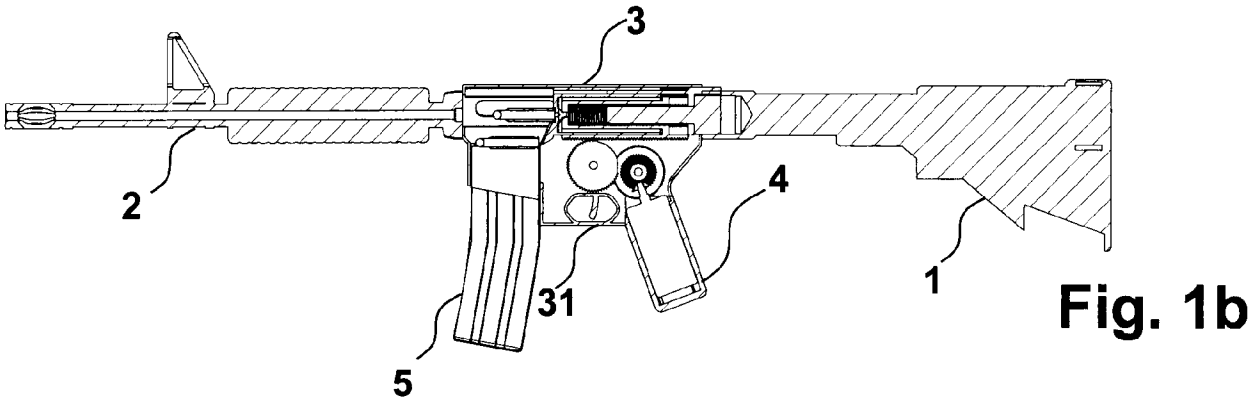
Figure 1C:
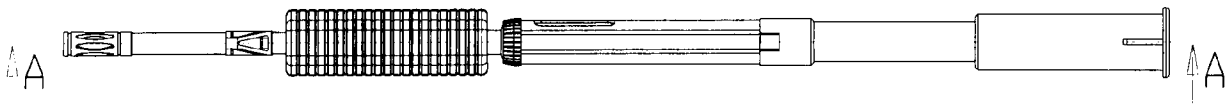

The hardball weapon according to the invention can be made in an embodiment having a known military rifle as model, cf. FIGS. 1*a*-1*c*. The rifle is provided with a butt 1, a barrel 2 and a so-called weapon housing 3 containing a firing mechanism and provided with a pistol grip 4 and an ammunition magazine 5 which is detachable. In this embodiment, the hardball weapon is adapted to use cartridge-like ammunition, i.e. each bullet 6 is carried by a cartridge casing 7 so that the greatest possible similarity to real weapons is achieved for training purposes. Moreover, like real handguns, the weapon housing is provided with an ejection opening 8 at one side.

The pistol grip 4 contains an electric motor 10 with an associated not shown battery. A trigger 11 is in a not shown way connected with an electric switch so that actuating the trigger 11 causes the motor 10 to run. The motor 10 runs in one direction of rotation and may by means of suitable, commercially available electronics be controlled so that it runs a certain number of revolutions for each actuation of the trigger, either by time control or by controlling the number of revolutions, so that the motor performs that which is described below when firing a single bullet, as with single shots with a weapon. The electronic control may also be adapted so that the motor 10 continues its running by continuously actuating the trigger so as to resemble automatic firing with a handgun.

At its free end, the shaft of the motor 10 is provided with a conical bevel pinion which together with an angular crown wheel in the gear form a bevel gear drive for driving the reciprocating firing mechanism.

Figure 3:
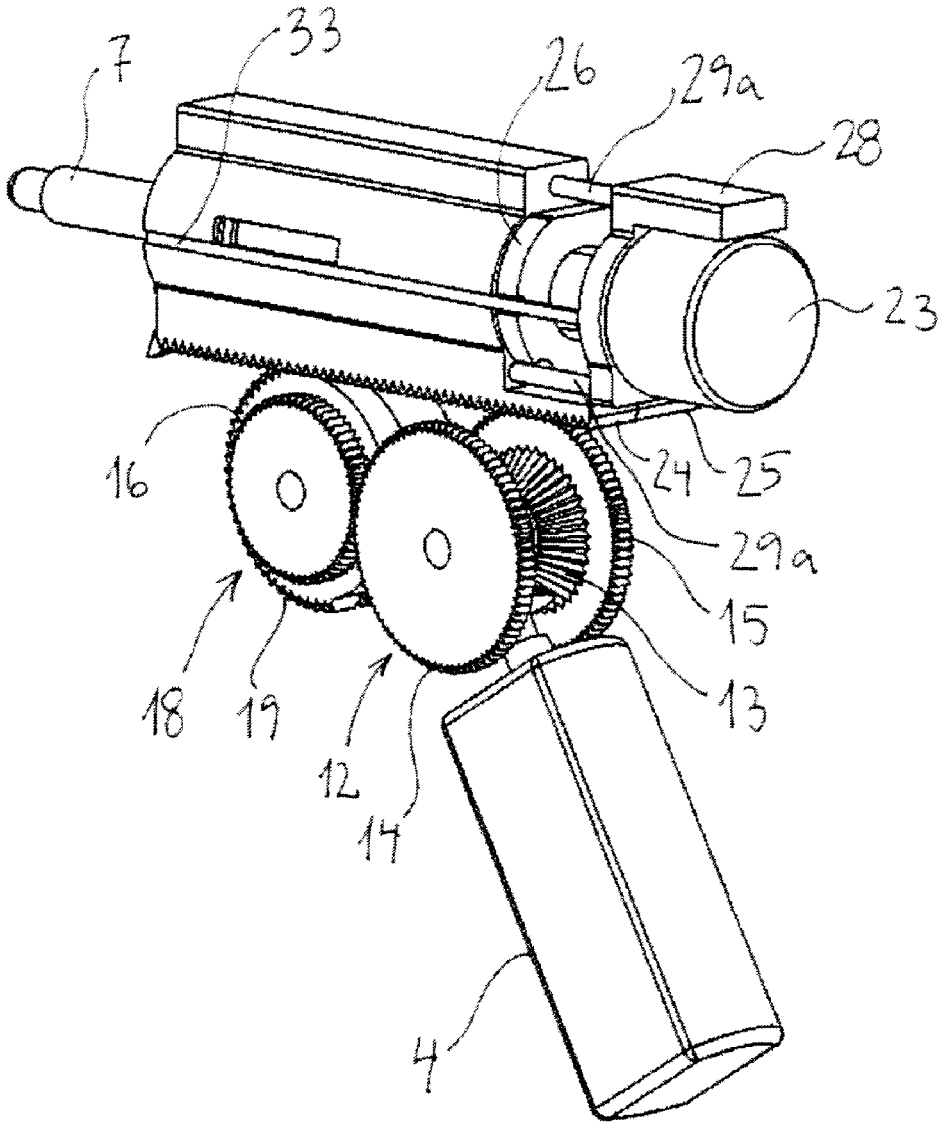
FIG. 3 shows the firing mechanism itself with gear box and motor in perspective view obliquely from behind.
Figure 4:
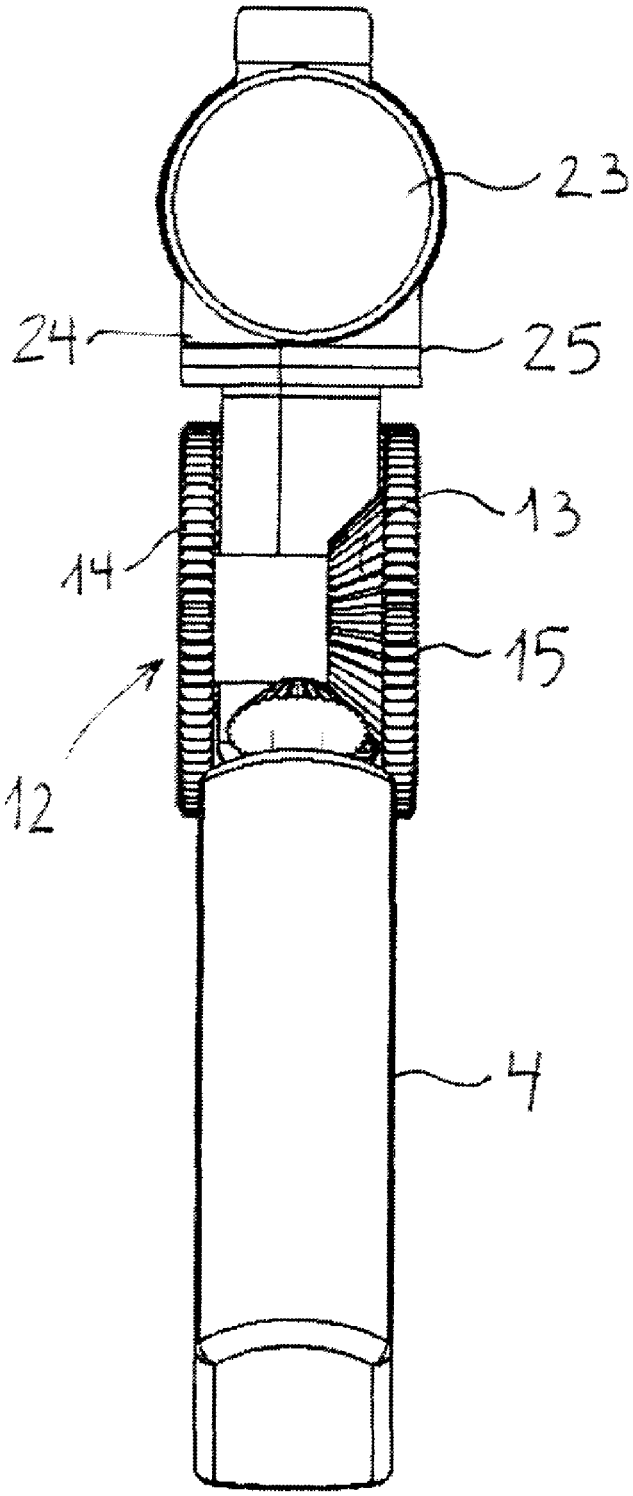
FIG. 4 shows the same as FIG. 3, but seen from behind and perpendicularly to the plane III.
Figure 5:
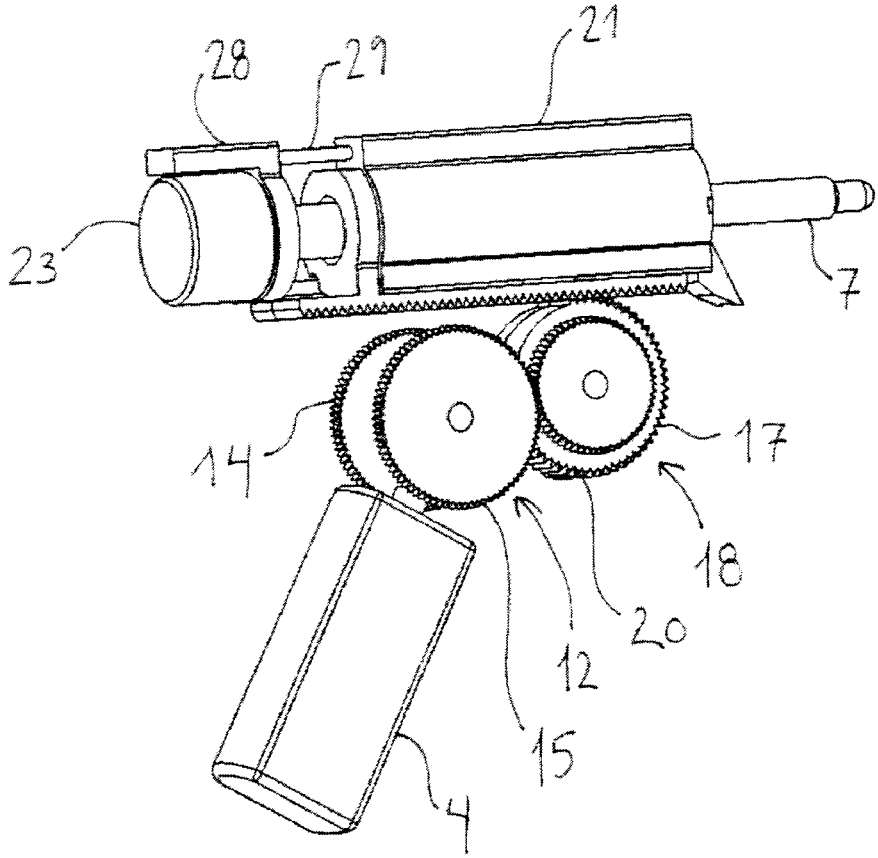
FIG. 5 shows the same as FIG. 3, but in perspective view obliquely from behind the other side.

The general design of the gear and its gear wheels and the firing mechanism appears in general on FIGS. 3-5. The shaft on the motor 10 is thus drivingly connected with a rearmost gear wheel 12 which is provided with in total three sets of teeth 13, 14 and 15. The first set of teeth 13 is a crown wheel which together with the bevel pinion on the motor shaft form the bevel gear for rotating the entire gear wheel 12. The second and third sets of teeth 14, 15 are two mutually parallel and identical cylindric gear rims that may drive corresponding cylindric sets of teeth 16, 17 on a foremost gear wheel 18. Between the sets of teeth 16, 17, there are two other sets of teeth 19, 20 which are also cylindric but with greater diameter than the sets of teeth 16, 17.

The sets of teeth 19, 20 of the foremost gear wheel engage two parallel, but mutually displaceable toothed racks 24 and 25, respectively, at the bottom side of the firing mechanism, which among others includes a movable bolt or first piston means 21, a pressurised air piston or second piston means 26 and an non-moving fixed plug 23.

The first toothed rack 24 is fastened to or cast integrally with the first piston means 21, and the second toothed rack 25 is fastened to or cast integrally with the second piston means 26. The two piston means 21, 26 are mutually displaceably seated and at the same time displaceably seated relative to the plug 23. This is illustrated to some degree on FIGS. 2, 6 and 7.

Figure 2:
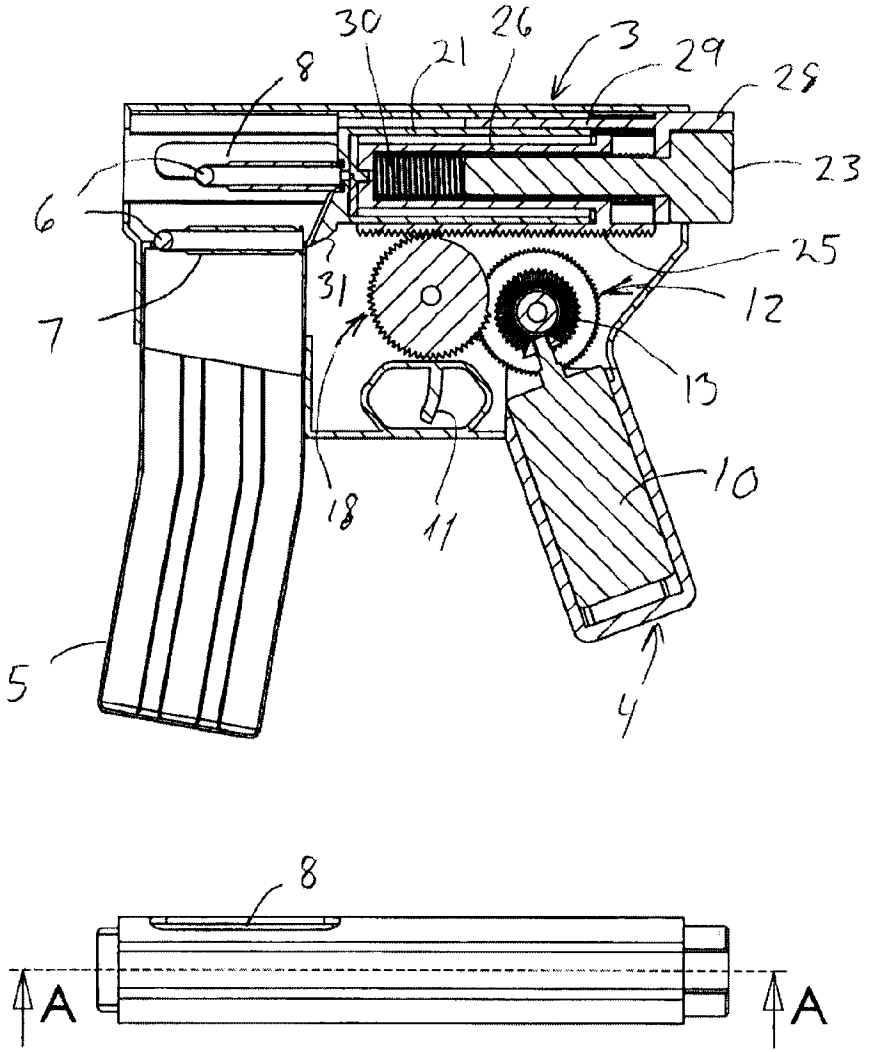
FIG. 2 shows an enlarged detail of FIG. 1*b*, including the weapon housing with pistol grip and attached ammunition magazine.
Figure 10:
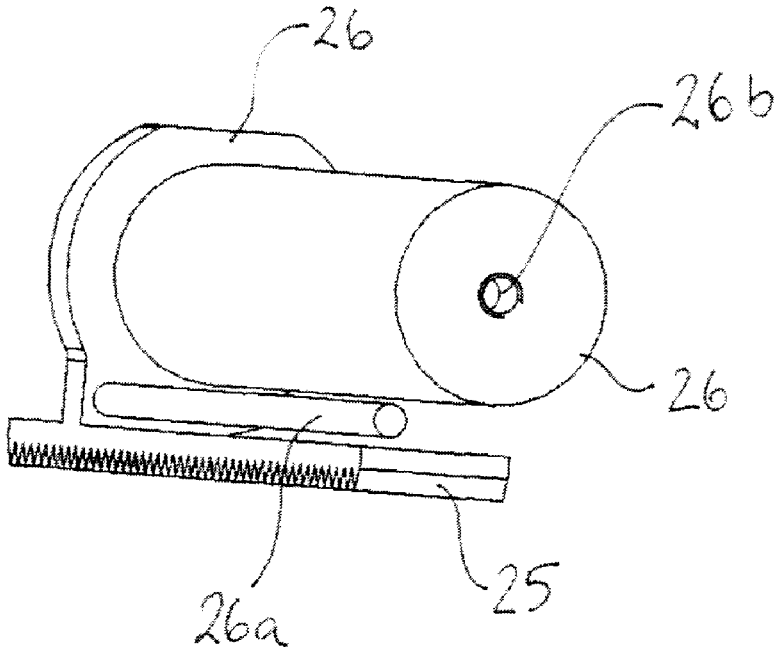
FIG. 10 shows separately a piston means for forming an air pressure in perspective view from the side facing the barrel in the weapon.

The plug 23 is, as shown on FIG. 2, a cylindric element projecting centrally into the firing mechanism. From behind, the plug 23 is disposed in a holder 28 which is provided with several, in this embodiment two, parallel guides 29 (both shown on FIG. 6) projecting into the firing mechanism accommodating and guiding the movable bolt 21. The plug 23 and the holder 28 together form a fixed bolt in the hardball weapon. The piston means 26 is provided with a guide 26*a*, see FIGS. 7 and 10, projecting into a not shown guideway in the movable bolt 21. The hole 26*b* is a hole for mounting a screw closing the hole 26*b*.

Around a central inwards projecting part 23*a* of the plug 23, a compression spring 30 is seated, extending into the hollow cylindric part of the piston means 26 and at its foremost end abutting on the inner side of the internal end face of the second piston means 26, where the compression spring 30 at its rearmost end abuts on an internal face of the holder 28. The spring 30 is shown in FIG. 2. The spring 30 enables prestressing the second piston means 26 so that when the piston means 26 is released, it will be moved forward with great force, thereby producing air pressure between its outer front surface and the inner side of the second piston means 21.

Figure 6:
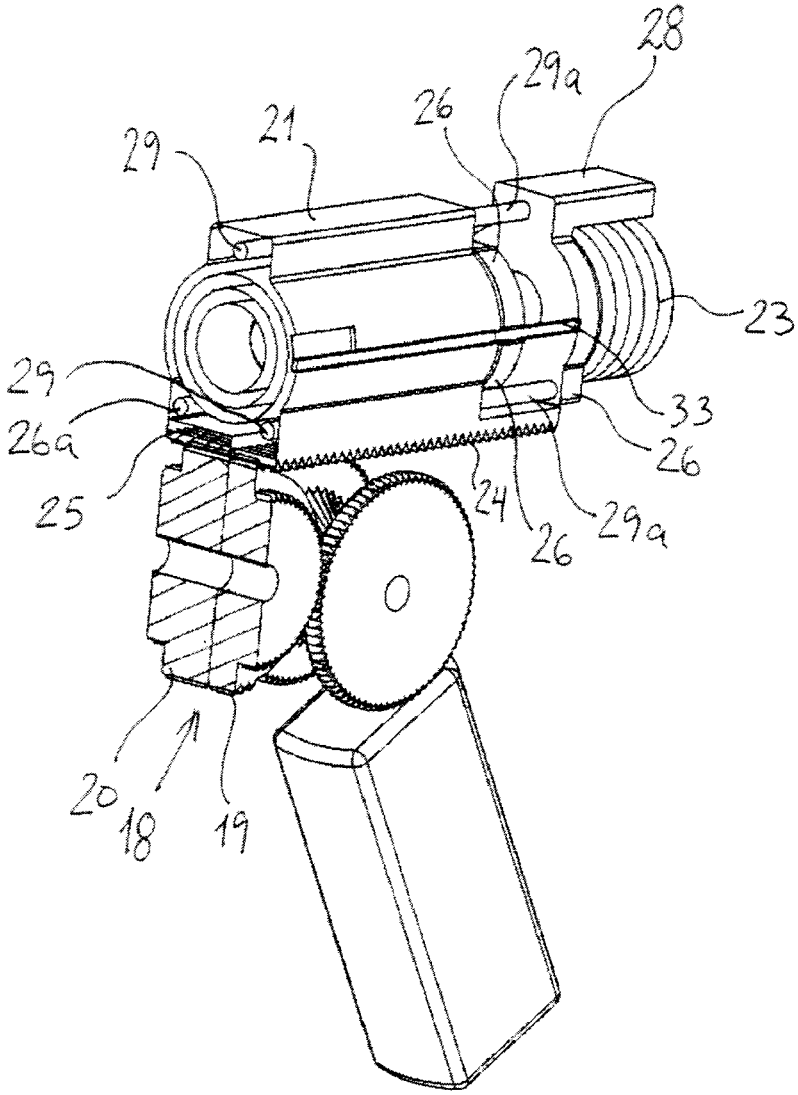
FIG. 6 shows a detail of the firing mechanism in section through the centre of a front gear wheel in the gear.

Around each guide 29, a compression spring 29*a* is seated, abutting on the mutually facing surfaces of the movable bolt 21 and the holder 28, respectively, see FIG. 6, so that these springs around the guides 29 press the bolt 21 forwards and away from the holder 28. In the embodiment, these two springs 29*a* are each so much weaker than the compression spring 30, so that the total force of the springs around the guides 29 is substantially less than the force of the one spring 30.

Figure 7:
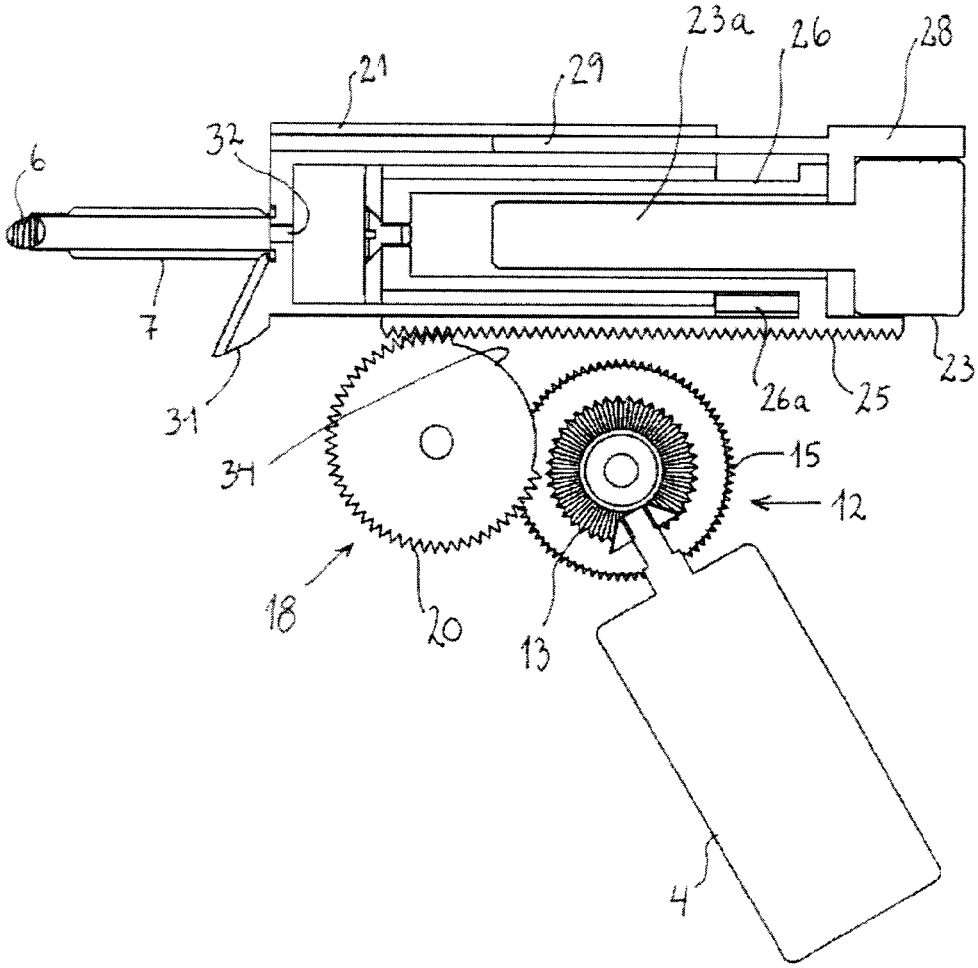
FIG. 7 shows a vertical longitudinal section through the firing mechanism and the gear wheels at the time immediately before firing a bullet, where a cartridge has been fed into a not shown cartridge chamber.

At the front, the movable bolt or piston means 21 is provided with a driver 31, which as shown on FIG. 2 carries the rear end of a cartridge casing 7 forwards, so that the cartridge is moved into the cartridge chamber. Moreover, in its foremost end wall the movable bolt 21 is provided with a central aperture 32 through which air can be pressed out into the interior of the cartridge casing 7, as seen in FIG. 7.

Figure 11:
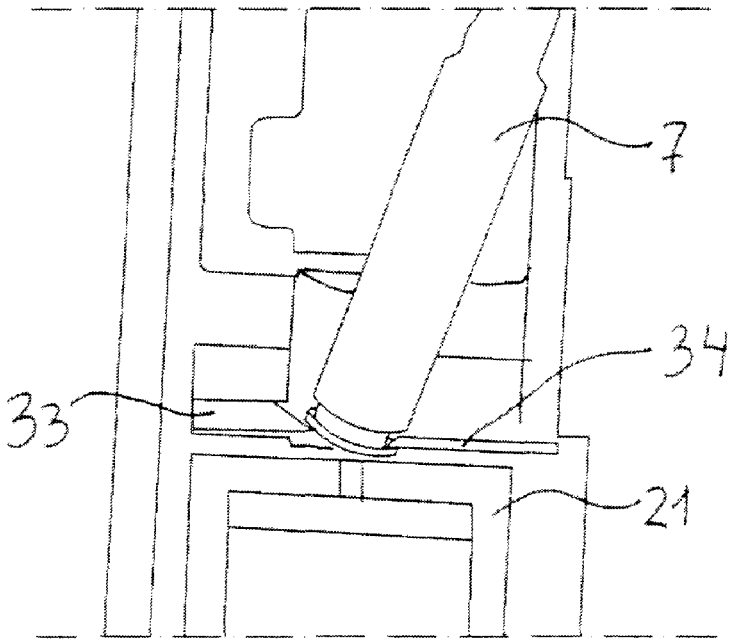
FIG. 11 shows a detail of the ejector mechanism for the cartridge casing during ejection in a horizontal section.

In the shown embodiment of the invention, the firing mechanism is furthermore provided with a fixed retainer tab 34 at side of the movable bolt 21 facing the cartridge and an ejector means 33, 33*a* consisting of a longitudinal lug seated at one side of the movable bolt 21 and extending into a recess in the end face of the bolt 21, se particularly FIGS. 3 and 11. When taking a cartridge 7 from the magazine 5 and during firing, the collar 35 of the cartridge is wedged between the tab 34 and the end face of the bolt 21 to the right on FIG. 11. The ejector means 33 operates in that when the movable bolt 21 is retracted towards the plug/holder 28, the rearmost end of the element 33 will strike the holder 28. The lug 33*a* of the element will thereby be pushed slightly forward of the front side of the bolt 21, and the foremost lug 33*a* of the element 33 will strike the rear end of the cartridge 7 to the left on FIG. 11, i.e. at the side facing away from the opening 8. Then the cartridge casing 7 is ejected through the opening 8. Other ejecting devices for cartridge casings are possible within the scope of the invention.

Figure 12:
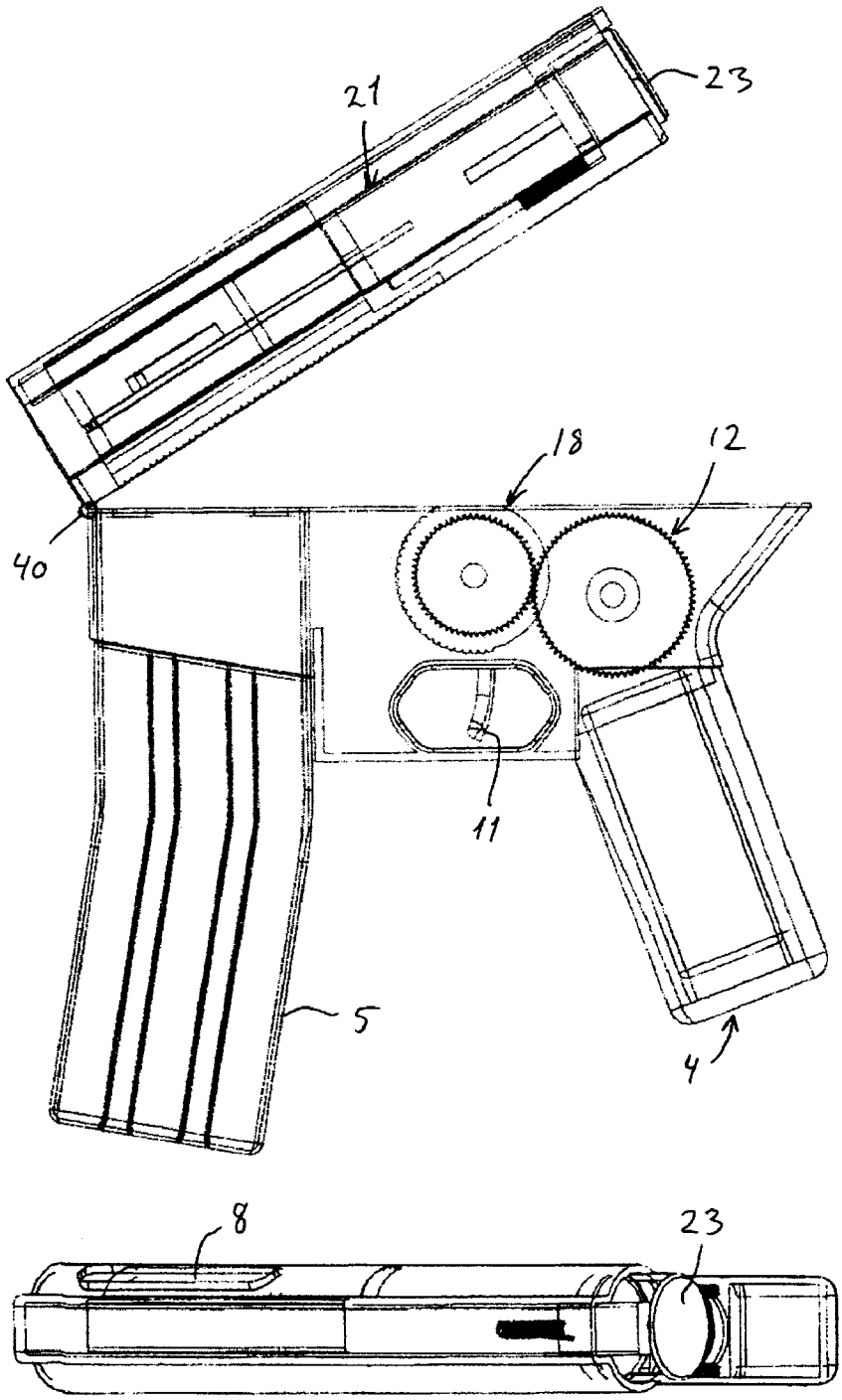
FIG. 12 shows in principle the same as FIG. 2, but where the weapon housing has been opened by pivoting the upper part for inspection, repair and adjustment.

As shown on FIG. 12, the weapon housing 3 is divided into two parts, so that the upper part can be pivoted about a hinge 40 provided between the ammunition magazine 5 and the point where the barrel 2 is secured to the weapon housing 3. By the pivoting, the firing mechanism will be separated so that the gear wheels 12 and 18 remain in the lower part, while the pistons 21 and 26, the plug 23, springs, guides etc. are carried with the upper part of the housing 3. In this way there is immediate access to the gear wheels for inspection and replacement. By screwing off the plug 23, which has an external thread, the pistons 21, 26 with associated parts be drawn rearwards out of the upper part of the weapon housing 3 for service and repair. At the same time, it is possible to replace the spring 30 in order to increase or reduce the firing power, e.g. in a pause during the game or the exercise.

The function of the hardball weapon according to the invention and its firing mechanism is now described in detail below.

The sets of teeth 19, 20 are, as indicated on the drawing, adapted with a segment of a circle without any teeth on the gear wheel, which is indicated by the reference number 34. Only one tooth-free segment 34 is shown on the drawing, cf. FIGS. 2 and 7-9. The two segments 34 are disposed slightly offset with regard to the function, which is to be described now. The segments 34 have the purpose of releasing the toothed racks 24, 25 and the associated pistons 21 and 26, which are under pressure from the not shown springs around the guides 29 and the spring 30, respectively, at different times, as also described further below.

Figure 8:
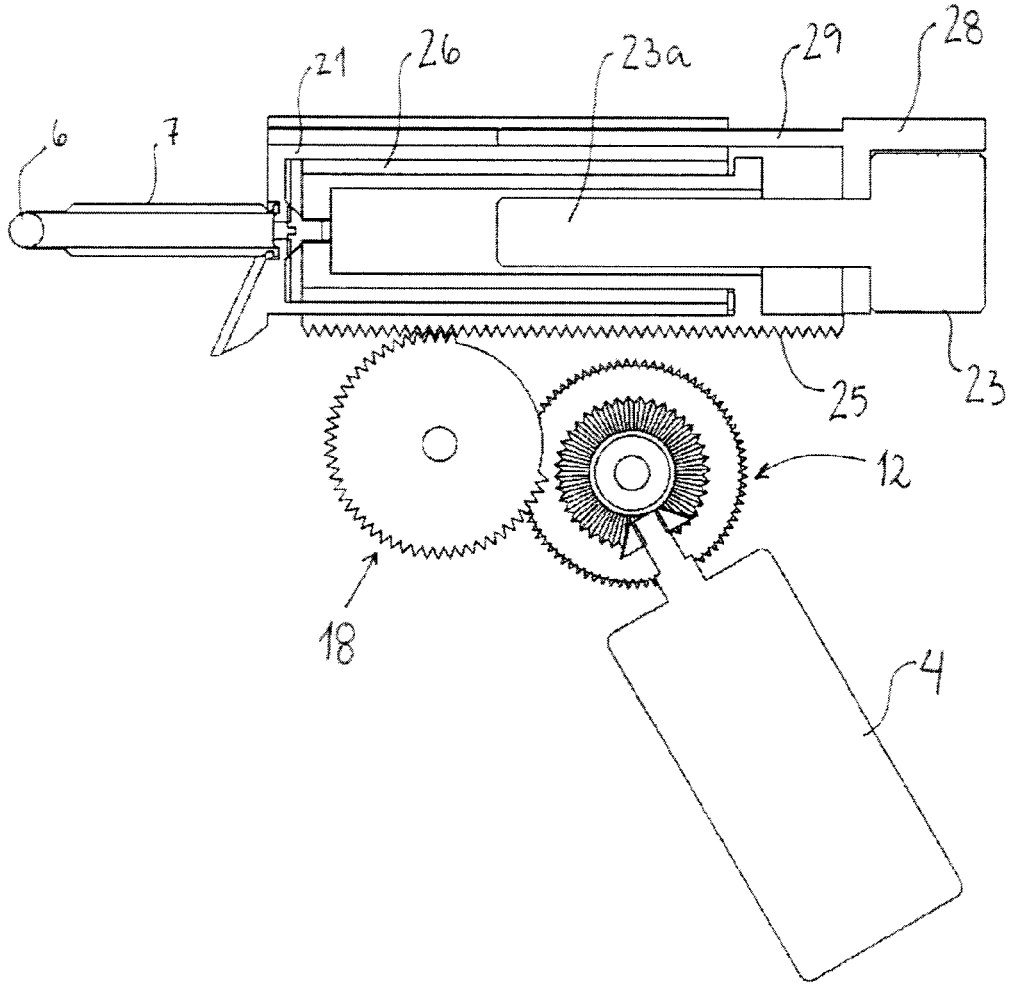
FIG. 8 shows the same as FIG. 7, but where the firing mechanism is in another position at the time where a second piston means is displaced forward for producing air pressure for firing the bullet.
Figure 9:
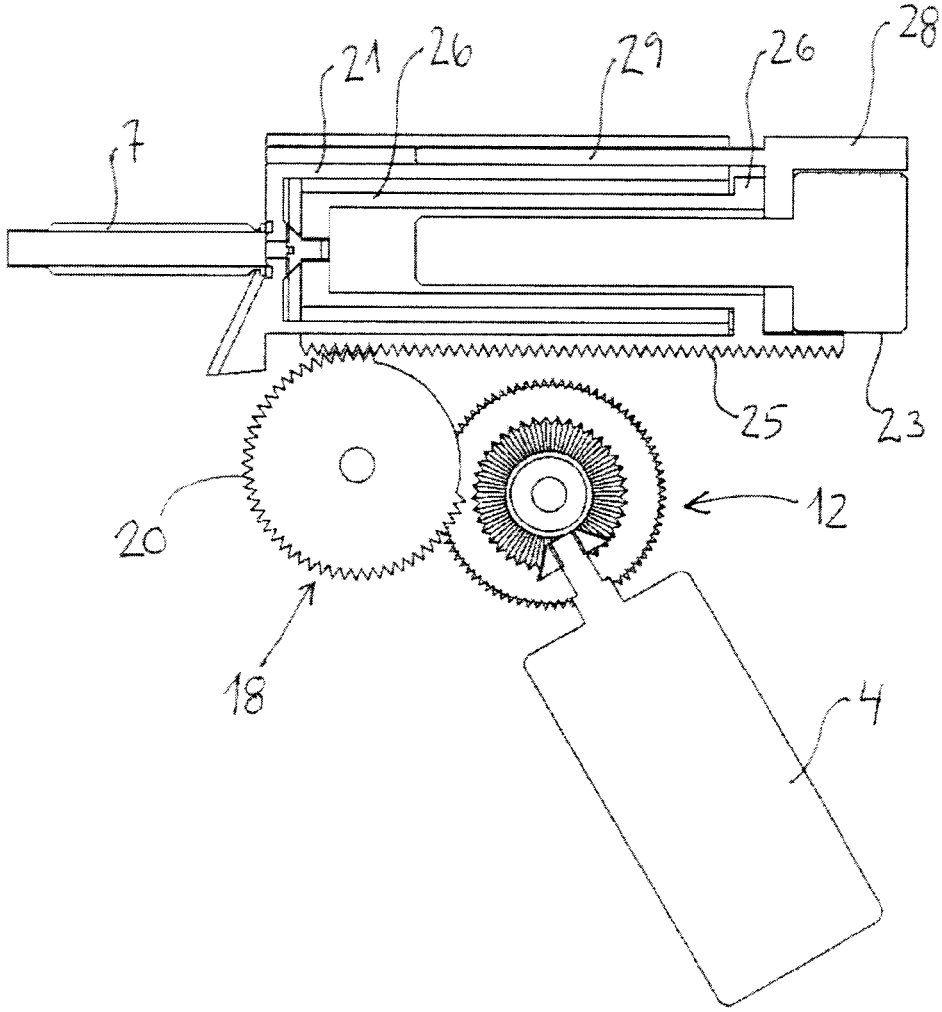
FIG. 9 shows the same as FIG. 7, but where the firing mechanism is in a third position in retracted position for ejecting a cartridge casing.

FIGS. 7, 8 and 9 show three different times during the firing of a bullet from the hardball weapon according to the invention. FIG. 7 thus shows the time where a cartridge 7 has been taken from the ammunition magazine 5 by the driver 31 and moved into a not shown cartridge chamber in the barrel 2. In this situation, the toothless area on the toothed rim 19 is disposed opposite the toothed rod 24, which together with the piston 21 as a consequence thereof are pressed forwards by action of the not shown springs around the guides 29. During this advancing operation, the rear end of the cartridge casing fixes itself at the front side of the movable bolt 21. The second piston means or pressurised air piston 26 within the movable bolt 21 is retained against the force of the spring 30 by means of the toothed rod 25 and the set of teeth 20. By continued, alternatively repeated, pressure on the trigger 11, the gear wheel 18 is rotated and with it the set of teeth 20 so that the segment 34 without teeth on the wheel 18 is rotated until it is opposite the teeth of the toothed rod 25. Thereby the piston means 26 is released so that the spring 30 may drive the piston 26 forwards against the front end of the bolt 21 and thereby against the cartridge 7. An overpressure thereby arises inside the movable bolt 21, which overpressure is conducted onwards through the aperture 32 to the inner side of the cartridge casing 7. When the pressure is sufficiently high, the bullet 6 will leave the casing 7 and be fired through the barrel 2. On FIG. 8 the pressurised air piston 26 appears in its forward position, immediately before the bullet 6 leaves the cartridge 7.

In a normal cycle, the movable bolt 21 is retracted together with the pressurised air piston 26 by the electric motor 4, as the toothed rims 19, 20 of the gear wheel 18 by continued rotation in the same direction engage the toothed rods 24, 25 again. Thereby, both piston means 21, 26 are retracted to their bottom position as shown on FIG. 9, where the ejector element 33, as previously mentioned, may release the cartridge 7. The firing mechanism is now ready for a new firing cycle, as all springs are tensioned.

The invention claimed is:

1. A hardball weapon with electrically activated firing of a bullet, including a weapon housing with pistol grip and trigger at its bottom side, a barrel for firing the bullet at the front, a cartridge magazine that may be mounted on the casing, and a reciprocating firing mechanism arranged in the weapon housing, the functional elements of the firing mechanism mounted directly in the weapon housing, where the firing mechanism is driven by an electric motor disposed in the pistol grip via a gear wheel arrangement and includes a piston means that may produce an air pressure for firing a bullet through the barrel, characterised in that the firing mechanism includes a first outer piston means that functions as a movable bolt in the weapon for moving a cartridge from the cartridge magazine into a cartridge chamber in the barrel and to extract the cartridge from cartridge chamber after firing, and a second piston means which is provided displaceably inside the first piston means and coaxially in relation thereto and airtightly fitting to the inner wall of the first piston means, where at its end facing the cartridge chamber the first piston means has an aperture for discharging pressurised air into. an adjacent end of a cartridge;

where both piston means are seated inside the weapon housing and guided by longitudinal guides extending inside and/or along the piston means and initiating from a plug which is fastened at the end of the weapon housing facing away from the barrel;

where a central guide is provided concentrically with and inside the second piston means, extending out from the plug; and where between the free end of the central guide and an inner end wall of the second piston means there is provided a compression spring, as the gear wheel arrangement includes a double gear wheel with a first set of teeth and a second set of teeth, the sets of teeth corresponding to and engaging respective parallel first and second toothed racks provided on first and second piston means, respectively, where rows of teeth of the first set of teeth and the second set of teeth are discontinuous and without any teeth at segments of the circumference of the double gear wheel, so that there is free travel between the two segments without teeth and the teeth of the toothed racks, and that the two segments without teeth are partly overlapping segments of a circle on the double gear wheel; and that the segments without teeth on first and second sets of teeth, respectively, during the rotation of the double gear wheel in its normal direction of rotation are mutually arranged so that the toothed rack of the first piston means is released from engaging the first set of teeth before the toothed rack of the second piston means is released from engaging the second set of teeth.

2. Hardball weapon according to claim 1, wherein at one side of the first piston means an ejector member is seated slidably in a slot running in parallel with the direction of movement of the piston means, where the front end of the ejector member protrudes into an end face of the first piston means facing the cartridge chamber, and where the ejector member has a length so that it with its rear end at the rearwards movement of the piston means after firing can strike against a fixed stop at the plug.

3. Hardball weapon according to claim 1 or 2, wherein the weapon housing is divided longitudinally into a top part and a bottom part opposite the toothed racks, where top and bottom parts are interconnected with a hinge connection close to a socket of the weapon housing for the barrel and so that the weapon housing can be opened by pivoting the top part with the pistons, while the gear wheels remain in the bottom part.

* * * * *